United States Patent [19]

Cavanagh

[11] Patent Number: 4,642,157

[45] Date of Patent: Feb. 10, 1987

[54] TAPE APPLYING DEVICE

[75] Inventor: Michael J. Cavanagh, St. Paul, Minn.

[73] Assignee: Minnesota Mining and Manufacturing Company, Saint Paul, Minn.

[21] Appl. No.: 791,407

[22] Filed: Oct. 25, 1985

[51] Int. Cl.[4] ..... B31C 1/00

[52] U.S. Cl. ..... 156/468; 53/137; 156/486; 156/530; 156/522

[58] Field of Search ..... 156/486, 468, 475, 530, 156/522; 53/137

[56] References Cited

U.S. PATENT DOCUMENTS 2,510,131 6/1950 Morin ..... 156/468

3,915,786 10/1975 Collett et al. ..... 156/355

3,954,550 5/1976 Patterson ..... 156/486

4,238,269 12/1980 Deering ..... 156/465

*Primary Examiner*—David Simmons

*Attorney, Agent, or Firm*—Donald M. Sell; James A. Smith; William L. Huebsch

[57] ABSTRACT

A device adapted for applying L-shaped lengths of pressure sensitive adhesive coated tape on the peripheries of boxes moved past the device and for cutting the applied lengths of tape from a supply length of tape on the device, in which the mechanism for cutting the tape moves a cutting edge by which the tape is cut at about the same speed that the tape is moving in the longitudinal direction of the tape during engagement of the cutting edge with the tape.

5 Claims, 6 Drawing Figures

TAPE APPLYING DEVICE

TECHNICAL FIELD

This invention relates to devices for applying lengths of pressure sensitive adhesive coated tape to rectangular objects such as boxes driven along a predetermined path past the device, and particularly to the means in such devices for severing the tape applied to the objects from a supply length of tape on the device.

BACKGROUND ART

The art is replete with devices of the type described above, U.S. Pat. Nos. 3,915,786, 3,954,550 and 4,238,269 being illustrative examples. Such devices are commonly used to seal rectangular boxes filled with merchandise moved past the device either manually or by a conveyor. Typically such devices include an application member such as a roller for supporting an end of the tape adhesive side out in a contact position at which the tape end will be contacted by a box. Upon such contact the tape end adheres to the box. Further movement of the box then pulls the tape from the device between the box and the application member while the device presses the tape against the contour of the box. Subsequently, severing means on the device sever the applied length of tape from the supply length of tape and means on the device engages the tape adjacent the newly severed end and moves it with the application member back to its contact position for contact by the next box moved past the device.

Typically the severing means includes a knife having a serrated edge mounted at one edge of the path for the boxes and is controlled so that after a predetermined length of tape being applied to the box has been pulled past the knife, the knife will move causing the points of the serrated edge to pierce through and sever the tape.

While such severing means works quite well when boxes are moved at a relatively slow and steady rate past the device, (as is normally the case when boxes are moved past the device by a conveyor) problems can arise when boxes are moved through the device at a relatively rapid rate, as will often occur when boxes are manually moved past the device. Under these circumstances, the tape is moving rapidly past the tips of the serrated knife which is essentially at a fixed position along the path of the tape as it cuts through the tape. Such rapid movement of the tape can break off the sharpened edge of the knife, particularly on the points along the serrated edge, causing the knife to become dull and resulting in uneven cut edges on the tape, or even failure to cut the tape. In extreme cases, blades which might last for six months when used to cut tape applied to boxes being moved by a conveyor at a relatively slow speed require changing every week to facilitate taping the same number of boxes per week manually moved rapidly past the device.

DISCLOSURE OF THE INVENTION

The present invention provides a device of the type described above in which the means for severing a predetermined length of tape from a supply length of tape will allow a sharp edge to be maintained on a serrated cutting knife in the means for severing even when objects are moved past the device at a relatively high rate of speed.

According to the present invention there is provided a device adapted for applying lengths of pressure sensitive adhesive coated tape from a supply length of tape seriatim on the peripheries of rectangular objects or boxes moved along a predetermined path in a first direction past the device. The device comprises (1) an application member or roller having an arcuate periphery; (2) means adapted for defining a tape path for the supply length of tape to the periphery of the application roller with the adhesive coating disposed away from the application roller; (3) means for mounting the application roller on a frame for the device to afford movement thereof from a contact position with the application roller in the path to afford contact between the length of tape disposed along the application roller and the leading surface of a box driven along the path in the first direction to adhere the tape to the leading surface of the box, to a second position while pressing tape against the leading surface of the box; and (4) severing means mounted on the frame including a knife blade having a cutting edge and adapted to be activated by movement of the box past a predetermined position along the path for causing the cutting edge of the knife blade to sever a length of tape being applied to the box from the supply length of tape.

In the improved device according to the present invention the means for causing the cutting edge of the knife blade to sever a length of tape being applied to the box from the supply length of tape includes means for moving the cutting edge at about the same speed that the tape is moving in the longitudinal direction of the tape during engagement of the cutting edge with the tape.

Preferably this improvement is accomplished by the device including cam means adapted to engage a box for moving the application roller to a third position with the application roller spaced from the path after movement of the leading surface of the box past the application roller at its second position so that the application roller will guide the tape to be applied to the box along a path portion between the front surface of the box and the application roller that forms a decreasing acute angle with the side surface of the box after the box moves past the application roller, and means adapted to be activated by movement of the leading surface of the box along the path past the application roller for moving the cutting edge of the knife blade generally in synchronism with tape moving along that path portion while causing the cutting edge to intersect the tape along that path portion to sever it.

In the disclosed embodiment of the invention, the means adapted to be activated by movement of the leading surface of the box along the path past the application roller for moving the cutting edge of the knife blade generally in synchronism with tape moving along that path portion comprises (1) means for mounting a contact member or roller on the frame to afford movement thereof between an extended position with the contact member in the path at a portion spaced along the path from the application roller, and a retracted position with the contact member along the side surface of the object, to which retracted position the contact member will be moved by contact with the leading surface of the box moving along the path; and (2) means coupled between the means for mounting the contact member and the knife blade for causing movement of the cutting edge of the knife blade generally in synchronism with tape moving with the box and extending between the application roller in the third position and the leading surface of the box while causing the cutting edge to intersect that tape as the contact member is moved from its extended to its retracted position by contact with the leading surface of the moving box.

DESCRIPTION OF THE DRAWING

The present invention will be further described with reference to the accompanying drawing wherein like numerals refer to like parts throughout the several views and wherein.

DETAILED DESCRIPTION

Figure 1:
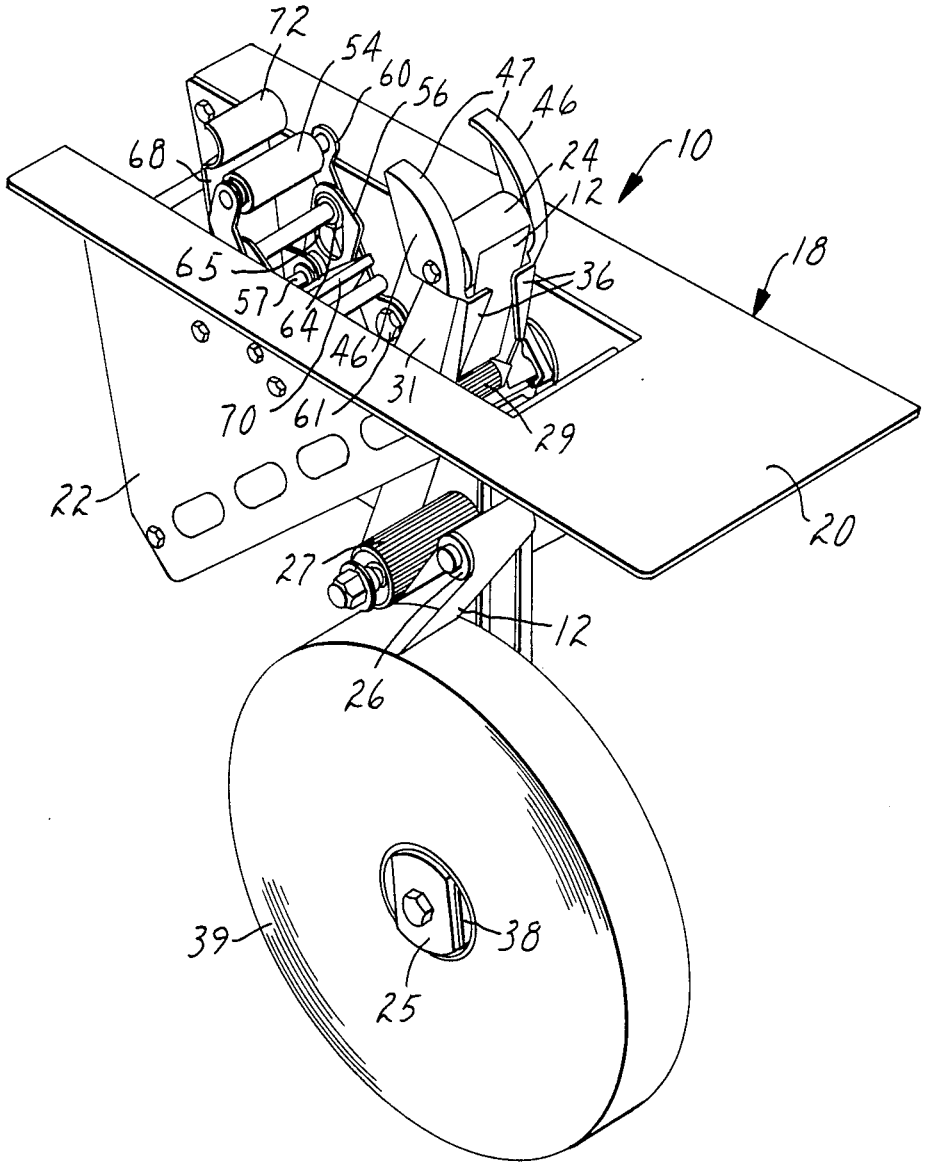
FIG. 1 is a view in perspective of a tape-applying device according to the present invention.

Referring now to the drawing there is shown a device 10 according to the present invention generally designated by the reference numeral 10.

The device 10 is adapted for applying L-shaped lengths of pressure sensitive adhesive coated tape 12 from a supply length of the tape 12 seriatim around edges on the peripheries of rectangular objects or boxes 16 moved along a predetermined path in a first direction (indicated by the arrow) past the device 10.

Generally, the device 10 comprises a frame 18 including a plate having a planar surface 20 defining the path for the objects 16, and parallel side walls 22 flanking an opening through the plate and projecting at about right angles away from the plate on its side opposite the surface 20, between which side walls 22 the various movable portions of the device 10 are mounted. Those movable portions include an application member or roller 24 having an arcuate or cylindrical periphery, and means including a series of hubs and rollers 25, 26, 27, 28, 29 and 30 for defining a tape path for the supply length of the tape 12 to the periphery of the application roller 24 with the adhesive coating on the tape 14 disposed away from the application roller 24. Means are provided in the form of a carriage 31 for mounting the application roller 24 on the frame 18 to afford linear movement of the carriage 31 and application roller 24 from (1) a contact position (FIGS. 1 and 2) with the application member 24 in the path for the boxes 16 to afford contact between an end portion of the tape 12 disposed along the application member 24 and the leading surface of one of the boxes 16 driven along the path in the first direction to adhere the end portion of the tape 12 to the leading surface of the box 16, to (2) a second position while pressing the tape 12 against the leading surface of the box 16, and (3) back to the contact position. Also provided are means mounted on the frame 18 including a knife blade 32 having a cutting edge 34, and adapted to be activated by movement of the box 16 past a predetermined position along the path for causing the cutting edge 34 of the knife blade 32 to sever a length of the tape 12 being applied to the box 16 from the supply length of the tape 12; and means in the form of opposed triangular ears 36 projecting into the tape path adjacent the application roller 24 for positioning an end portion of the supply length of the tape 12 adjacent the application roller 24 when the application roller 24 is in the contact position and during movement of the application roller 24 from its second position back to its contact position. In the improved device 10 the means for causing the cutting edge 34 of the knife blade 32 to sever a length of the tape 12 being applied to the box 16 from the supply length of the tape 12 includes means for moving the cutting edge 34 at about the same speed that the tape 12 is moving in the longitudinal direction of the tape 12 during engagement of the cutting edge 34 with the tape 12 which significantly decreases wear on the cutting edge 34 during use of the device 10, particularly when boxes 16 are rapidly moved through the device 10.

More specifically, the means in the device 10 for defining a tape route for the supply length of the tape 12 to the periphery of the application roller 24 comprises the hub 25 which is freely rotatably mounted on the frame 18 and carries two leaf springs 38 each fixed at one end on the hub 25 and having distal ends biased outwardly to frictionally engage and releasably hold the core for a roll 39 of the tape 12 on the hub 25; the first guide roller 26 which is freely rotatably mounted on the frame 18 and contacted by the backing of the tape 12 around almost 180 degrees of its periphery; and the brake roller 27 which is rotatably mounted on and connected by an adjustable friction brake to the frame 18 and has an axially serrated polymeric (e.g., Delrin ®) periphery contacted for about 180 degrees by the pressure sensitive adhesive on the tape 12. From the brake roller 27, the tape 12 extends between the three generally aligned guide rollers 28, 29 and 30 each freely rotatably mounted on the carriage 31 on which the application roller 24 is mounted with the outer rollers 28 and 30 contacting the backing on the tape 12, and the center roller 29 having an axially serrated polymeric periphery that is contacted by the adhesive coating on the tape 12. From the guide roller 30, the tape 12 moves with its backing along a plate like portion 40 of the carriage 31 to the application roller 24 with its adhesive coating adjacent the triangular ears 36 which, with the brake roller 27 and guide roller 29, provide the means for positioning an end portion of the tape 14 adjacent the application roller 24. The brake roller 27 and guide roller 29 restrict longitudinal movement of the tape 14 along the path, and the ears 36 restrict flexing of the end portion of the tape 12 away from the application roller 24.

In addition to the carriage 31, the means for mounting the application roller 24 on the frame 18 to afford linear movement between its contact and second position comprises elongate tracks 42 fixed in opposed relationship on the side walls 22 and disposed at about a 45 degree angle to the planar surface 20, and two spaced rollers (not shown) on each side of the carriage 31 adapted to roll within longitudinal recesses 45 in the elongate tracks 42. The tracks 42 are oriented so that a component of the linear movement of the application roller 24 and carriage 31 from their contact to their second positions is in the first direction that boxes 16 are moved along the path to provide the advantage described in U.S. Pat. No. 4,238,269 incorporated herein by reference.

Figure 2:
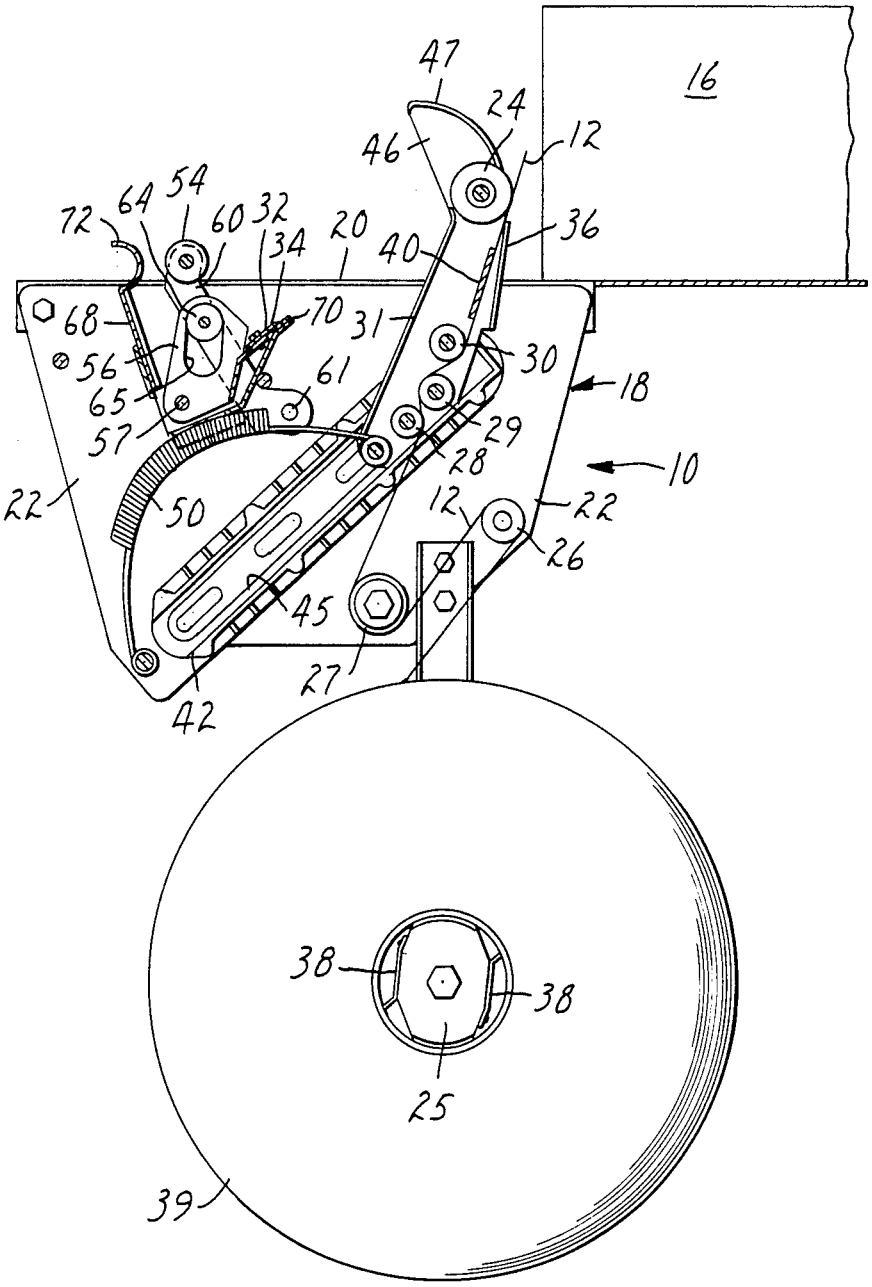
FIG. 2 is a sectional side view of the device shown in FIG. 1.
Figure 3:
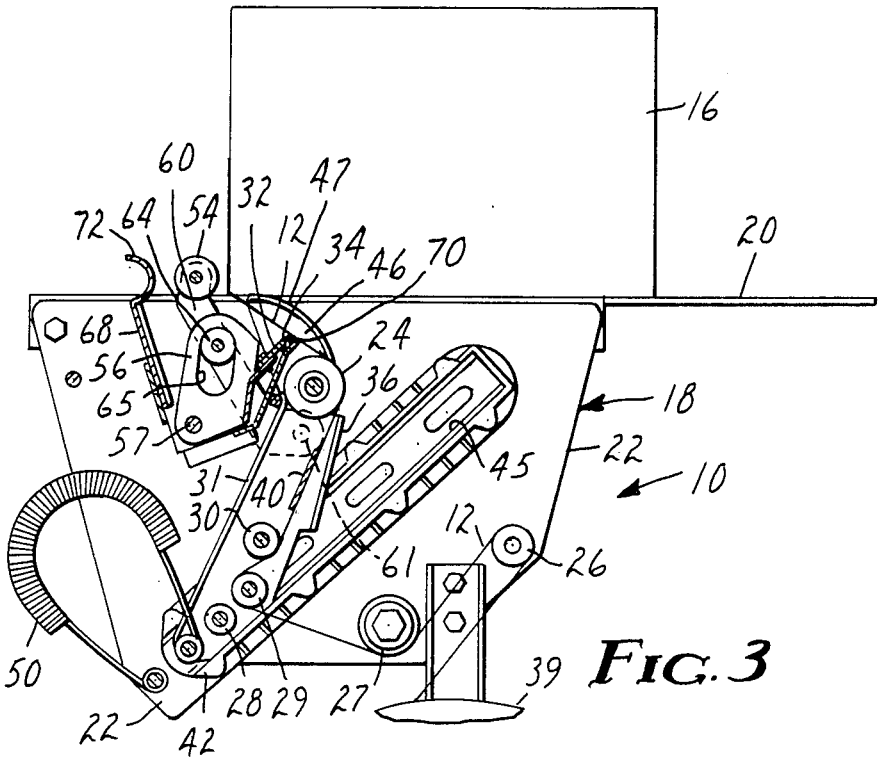
FIGS. 3, 4, and 5 are fragmentary sectional views similar to FIG. 2 sequentially illustrating the application of tape to a box by the device shown in FIG. 1.

The means in the device 10 for moving the cutting edge 34 at about the same speed that the tape 12 is moved in the longitudinal direction of the tape during engagement of the cutting edge 34 with the tape 12 is provided in that the tracks 42 are sufficiently long to also afford movement of the application roller 24 past the second position to a third position with the application roller 24 spaced from the path between the side walls 22; and the device 10 includes cam means in the form of spaced cam members 46 projecting past the opposite ends of the application roller 24 and having arcuate surfaces 47 adapted to be engaged by a box 16 moving along the path to move the application roller 24 to the third position (FIGS. 3, 4 and 5) after movement of the leading surface of the box 16 past the application roller 24 at its second position. Thus, after the leading surface of the box 16 has contacted the adhesive surface of the tape end portion positioned along the application roller 24 as shown in FIGS. 1 and 2, and further movement of the box 16 along the path has moved the application roller 24 and the carriage 31 on which the application roller 24 is mounted to their second position along the tracks 42 in opposition to biasing means provided by an arched coil spring 50 having its opposite ends fixed respectively to the carriage 31 and the frame 18 so that the application roller 24 moves along and presses the tape 12 against the leading surface of the box 16, the leading surface of the box 16 will move along the arcuate surfaces 47 of the spaced cam members 46, causing the application roller 24 to move to and be retained at its third position spaced from the path between the side walls 22 as the side surface of the box 16 moves along the ends of the cam members 46. In this third position (FIG. 3), the application roller 24 will guide the tape 12 to be applied to the box 16 between the cam members 46 and along a path portion between the leading surface of the box 16 and the application roller 24 that forms a decreasing acute angle with the side surface of the box 16 along the path as the box 16 moves past the application roller 24.

Also included in the means for moving the cutting edge 34 at about the same speed that the tape 12 is moved in the longitudinal direction of the tape during engagement of the cutting edge 34 with the tape 12 are means adapted to be activated by movement of the leading surface of the box 16 along the path past the application roller 24 for moving the cutting edge 34 of the knife blade 32 generally in synchronism with that path portion while causing the cutting edge 34 to intersect and sever the tape 12 tensioned along that path portion by the brake roller 27.

As illustrated, the means adapted to be activated by movement of the leading surface of the box 16 along the path past the application roller 24 for moving the cutting edge 34 of the knife blade 32 generally in synchronism with that path portion comprise a contact member or roller 54 having an arcuate or cylindrical pressure surface adapted to move along tape applied to the box 16; means mounting the contact roller 54 on the frame 18 to afford movement of the contact roller 54 between an extended position with the contact roller 54 in the path (FIGS. 1, 2 and 3) and a retracted position (FIGS. 4 and 5) with the contact roller 54 along the side surface of the box 16, to which retracted position the contact roller 54 can be moved from its extended position by contact of the leading surface of the box 16 moved along the path in the first direction with the contact roller 54, means for biasing the contact roller 54 toward its extended position so that in its retracted position the contact roller 54 will press the tape 12 being applied against the side surface of the box 16; and means coupled between the means for mounting the contact roller 54 and the knife blade 32 for causing movement of the cutting edge 34 of the knife blade 32 generally in synchronism with the tape 12 moving with the box 16 and extending between the application roller 24 in its third position and the leading surface of the box 16 while causing the cutting edge 34 to intersect the tape 12 as the contact roller 24 is moved from its extended to its retracted position by contact with the leading surface of the moving box 16.

The means coupled between the means for mounting the contact roller 54 and the knife blade 32 includes a knife support 56 having the knife blade 32 fixed along one end and being mounted on the frame 18 at a pin 57 for pivotal movement to move the knife blade 32 along an arc intersecting the path of tape moving with the box 16 and extending between the application roller 24 in its third position and the box 16 as the leading surface of the box 16 moves past the application roller 24; and cam means between the means for mounting the contact roller 54 and the knife support 56 for moving the knife support 56 to cause the knife blade 32 to move with and intersect the tape 12 as the contact roller 54 is moved from its contact to its retracted position by engagement with the front surface of the box 16.

As illustrated, the means for mounting the contact roller 54 comprises a bracket 60 rotatably supporting the contact roller 54 at one end, having its opposite end pivotably mounted on the side walls 22 by a pin 61 and having spaced legs positioned adjacent the side walls 22 and extending between the contact roller 54 and the pin 61. The contact roller 54 is spaced along the path in the first direction from the pin 61 so that contact between the leading surface of a box 16 and the contact roller will cause it to move to its retracted position (FIGS. 4 and 5) between the walls 22. The knife support 56 is positioned between the legs of the bracket 60 with the pin 57 about which the knife support 56 is pivotably mounted positioned along the path in the first direction from the pin 61 about which the bracket 60 is pivotably mounted. The cam means between the bracket 60 and the knife support 56 comprise roller bearings 64 mounted in opposed relationship on the legs of the bracket 60, and walls on the knife support 56 defining elongate slots 65 in which the bearings 64 are received. The bearings 64 and slots 65 are oriented so that movement of the bracket 60 and roller bearings 64 as the contact roller 54 is moved from its extended (FIG. 3) to its retracted (FIG. 4) position will move the knife support 56 to move the knife blade 32 from an initial position along an arcuate path in the first direction of movement of the box 16 to a final position. Bearing means in the form of coil springs (not shown) around the pin 61 and connected between the walls 22 and knife support 56 are provided for biasing the knife support to the initial position of the knife blade 32, and thereby through the cam means, provide the means for biasing the contact roller 54 to its extended position.

The shapes and locations of the various components including the contact roller 54, the bracket 60, the knife support 56, the knife blade 32, the pivot pins 61 and 57, the roller bearings 64 and the slots 65 are designed with the help of a computer so that for any speed of box 16 movement through the device the speed of the tape 12 and the cutting edge 34 of the knife blade 32 will be moving at almost exactly the same speed when the tips of the serrated cutting edge 34 contact the tape 12.

Also included in the device 10 are a safety means for covering the cutting edge 34 of the knife blade 32 except when the knife blade 32 is moved to cut the tape 12. The safety means comprise, a generally U-shaped sheet metal shield 68 having a central portion pivoted about the pin 56, having a protecting end adapted to contact the side of the knife blade 32 opposite the path, having a distal lip 70 that will project adjacent the cutting edge 34 when the protective end contacts the knife blade 32, and having an arcuate operating end 72 opposite the protecting end. The shield 68 is pivotably mounted on the pin 56 for pivotal movement between (1) a primary position at which the protecting end will contact the side of the blade 32 when the blade 32 is in its initial position, and the operating end 72 projects into the path at a position spaced in the first direction from the extended position of the contact roller 54; and (2) a secondary position at which the operating end 72 is on the side of the path between the side walls 22 and the protecting end is against the side of the knife blade 32 when the knife blade 32 is in its final position.

Operation

The operation of the device will now be explained during movement of a box 16 along the path.

Figure 4:
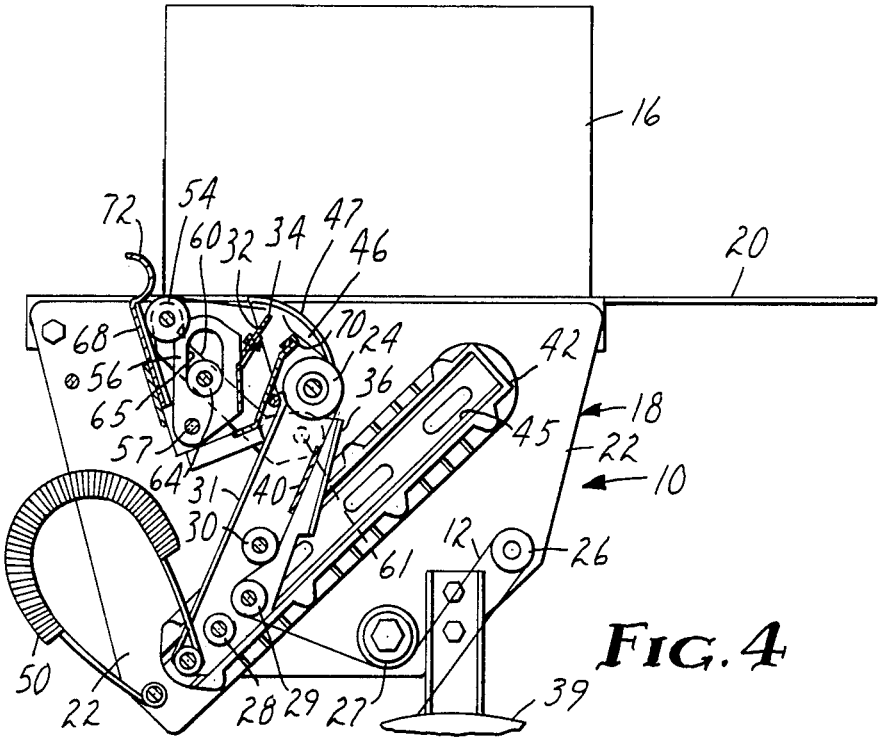
Figure 5:
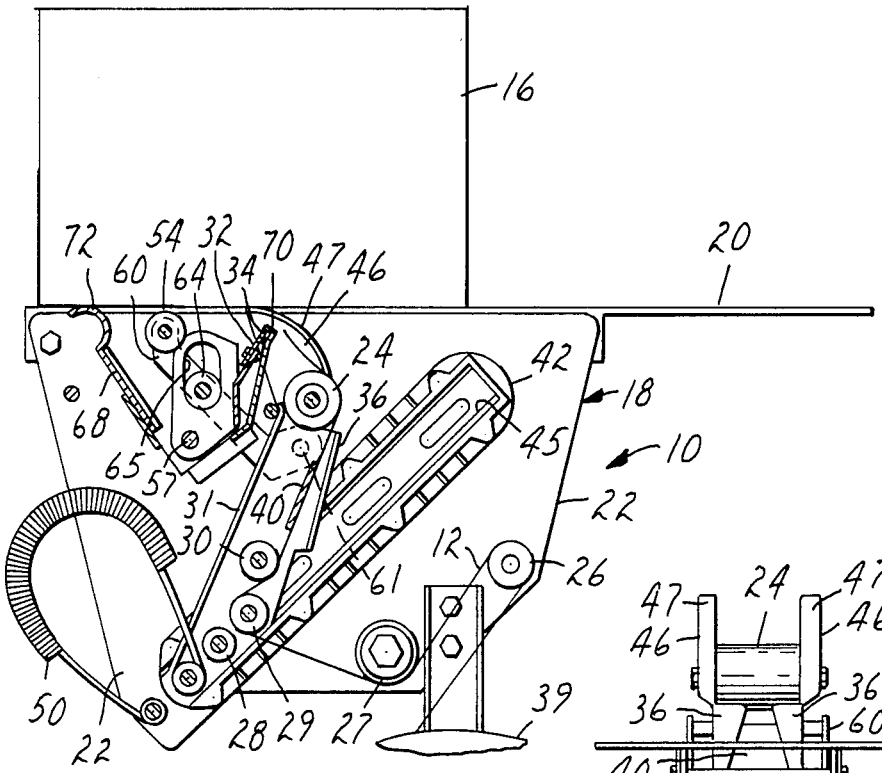
Figure 6:
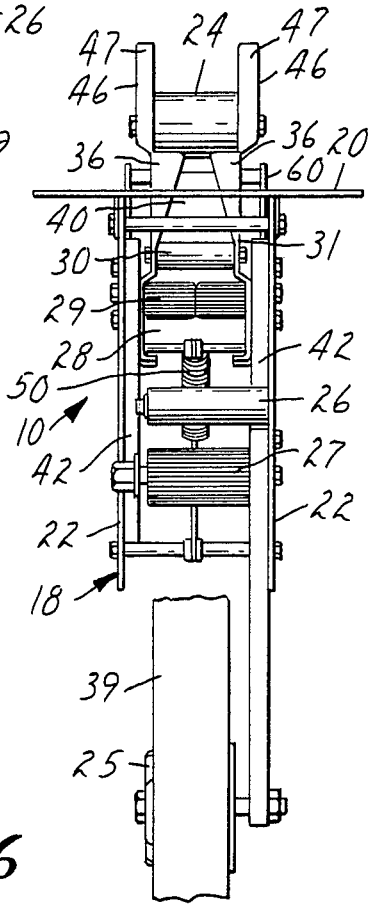
FIG. 6 is a front end view of the device illustrated in FIG. 1.

As the box 16 is moved along the path (FIG. 2), its leading surface will first contact the adhesive coated surface of an end portion of the tape 12 positioned along the application roller 24, which tape end portion will then adhere to the box 16. Further movement of the box 16 will cause the application roller 24 and the carriage 31 on which it is mounted to move along the tracks 42 on which the carriage 31 is mounted in opposition to the spring 38 so that the application roller 24 moves along and presses the tape 12 along the leading surface of the box 16 until the application roller 24 reaches its second position on the side of the path between the side walls 22. Subsequently the leading surface of the box 16 will move along the arcuate surfaces 47 on the cam member 46, causing the carriage 31 to move further along the tracks 42 to a third position (FIG. 3) at which the application roller 24 is spaced from the path, and at which third position the carriage 31 will be retained during further movement of the box 16 by contact between the side surface of the box 16 and the ends of the cam members 46. After the application roller 24 reaches its third position, further movement of the box 16 will pull tape 12 from the supply roll 39 under tension applied by the brake roller 27, and the application roller 24 will guide the tape 12 to be applied to the box 16 between the cam members 46 and along a path portion between the leading surface of the box 16 and the application roller 24 that forms a decreasing acute angle with the side surface of the box 16 along the path as the box 16 moves past the application roller 24. The leading surface of the box 16 will then contact the contact roller 54 initially in its extended position, causing it to pivot around the pin 61 from its extended position to its retracted position (FIG. 4). Such pivoting of the bracket 60 will cause the cam means provided by the roller 64 and walls defining the slots 65 to pivot the knife support about the pin 57 and thereby cause movement of the cutting edge 34 of the knife blade 32 generally in synchronism with the tape 12 moving with the box 16 and extending between the application roller 24 and the leading surface of the box 16 while causing the cutting edge 34 to intersect and sever the tape 12. Means which bias the contact roller 54 toward its extended position will then cause the contact roller 54 to move along and press the newly severed trailing end portion of the tape 12 being applied to the box 16 against the side surface of the box 16. Subsequently the leading surface of the box 16 will contact the operating end 72 of the shield 68, causing it to pivot on the pin 57 so that the protecting end of the shield 68 contacts the side surface of the knife blade 32 in its final position and the lip 70 again covers its cutting edge 34 (FIG. 5; and the shield 68 then holds the knife blade 32 in its final position and thereby (through the cam means) the contact roller 54 in its retracted position until the trailing edge of the box 16 moves past the operating end 72, whereupon the biasing means will simultaneously return the shield 68, knife blade 32 and contact roller 54 to their primary, initial, and extended positions respectively. Prior to moving past the operating end 72, the trailing edge of the box will move past the cam members 46 on the carriage 31 so that the spring 38 will move the carriage 31 and application roller 24 back to its contact position, carrying with it the newly severed end portion of the tape 12 positioned adjacent the application roller 24 ready for contact with the next box moved along the path.

The present invention has now been described with reference to one embodiment thereof. It will be apparent to those skilled in the art that many changes can be made in the embodiment described without departing from the scope of the present invention. Thus the scope of the present invention should not be limited to the structures described in this application, but only by structures described by the language of the claims and the equivalents of those structures.

I claim:

1. A device adapted for applying lengths of pressure sensitive adhesive coated tape from a supply length of tape seriatim on the peripheries of rectangular objects moved along a predetermined path in a first direction past the device, said device comprising:

a frame;

an application member having an arcuate periphery;

means adapted for defining a tape route for a said supply length of tape to the arcuate periphery of said application member with the adhesive coating disposed away from said application member;

means for mounting said application member on said frame to afford movement thereof from a contact position with said application member in said path to afford contact between a said length of tape disposed along said application member and the leading surface of a said object driven along said path in said first direction to adhere the tape to the leading surface object, to a second position while pressing tape against the leading surface of the object, to a third position with said application member spaced from said path and back to said contact position;

cam means adapted to engage an object for moving said application member to said third position after movement of the leading surface of a said object past said application member at said second position so that the application member will guide the tape to be applied to the article along a path between the front surface of the article and the application member that forms a decreasing acute angle with the side surface of the article after the article moves past the application member; and means mounted on said frame including a knife blade having a cutting edge, and adapted to be activated by movement of a said object along the path past the application member for moving the cutting edge of the knife blade generally in synchronism with tape, moving along said path portion while causing the cutting edge to intersect the tape along said path portion to sever it.

2. A device according to claim 1 wherein said means adapted to be activated by movement of the leading surface of the article along the path past the application member for moving the cutting edge of the knife blade generally in synchronism with tape moving along that path portion comprises:

a contact member;

means for mounting said contact member on said frame for movement between an extended position with said contact member in said path at a position spaced along the path from the application member, and a retracted position with said contact member along the side surface of the object, to which retracted position the contact member will be moved by contact with the leading surface of the object moving along the path; and means coupled between said means for mounting said contact member and said knife blade for causing movement of said cutting edge of the knife blade generally in synchronism with tape moving with said object and extending between said application member in said third position and said object while causing the cutting edge to intersect the tape as said contact member is moved from said extended to said retracted position by contact with the leading surface of the moving object.

3. A device according to claim 2 including means for biasing said contact member toward said extended position so that in said retracted position said contact member will press the tape being applied against the side surface of the object.

4. A device according to claim 1 wherein said means for mounting said application member on said frame mounts said application member for generally linear motion between said contact position and said third position with a component of movement for the application member being in said first direction.

5. A device according to claim 2 wherein said means coupled between said means for mounting said contact member and said knife blade includes a knife support having said knife blade fixed along one end and being mounted on said frame for pivotal movement to move said knife blade along an arc intersecting the path of tape moving with the object and extending between said application member in said third position and the object as the leading surface of the object moves past said application member, and cam means between said means for mounting said contact member and said knife support for moving said knife support to cause said knife blade to move along said arc in said first direction as said contact member is moved from its contact to its retracted position by engagement with the front surface of the object.

* * * * *